United States Patent [19]

Bowe et al.

[11] 4,177,716

[45] Dec. 11, 1979

[54] AUTOMATIC ENERGY SAVER AND FIRE DAMPER FOR EXHAUST SYSTEMS

[75] Inventors: Gerald J. Bowe, 3348 Morgan Ave., Eau Claire, Wis. 54701; Thadeus Skuba, Osseo, Wis.

[73] Assignee: Gerald J. Bowe, Eau Claire, Wis.

[21] Appl. No.: 879,735

[22] Filed: Feb. 21, 1978

[51] Int. Cl.[2] ..... F23J 11/00

[52] U.S. Cl. ..... 98/115 SB; 118/326; 118/DIG. 7; 126/285 R; 126/299 E; 169/61

[58] Field of Search ..... 98/115 R, 115 SB; 126/299 E, 285 R; 169/56, 60, 61, 59, 65; 118/DIG. 7, 326

[56] References Cited

U.S. PATENT DOCUMENTS

| | | | |
|---|---|---|---|
| 3,596,671 | 8/1971 | Scharfenberger | 98/115 SB |
| 3,616,745 | 11/1971 | Russell, Sr. | 98/115 R |
| 3,750,622 | 8/1973 | Repp et al. | 98/115 SB |
| 3,876,399 | 4/1975 | Saponaro | 98/115 SB |
| 3,967,942 | 7/1976 | Pain et al. | 118/DIG. 7 |

*Primary Examiner*—Ronald C. Capossela
*Attorney, Agent, or Firm*—Williamson, Bains, Moore & Hansen

[57] ABSTRACT

Exhaust system control apparatus operative to automatically close a damper in an exhaust duct leading from a spray booth when the spray booth is not in operation. A reversible damper motor is energized to rotate the damper to an open position when the spray booth is in operation. The damper motor is automatically reversed to close the damper in response to termination of spray booth operation. Energy is thus conserved by reducing the amount of heated air that would otherwise escape through the exhaust duct when the spray booth is not being used.

In case of fire, the same damper is automatically rotated to a closed position in the exhaust duct by a spring loaded sprocket assembly on the damper shaft. This safety action takes place in response to the melting of a fusible link located in the exhaust duct and connected to a sprocket retention cable.

10 Claims, 3 Drawing Figures

FIG. 2
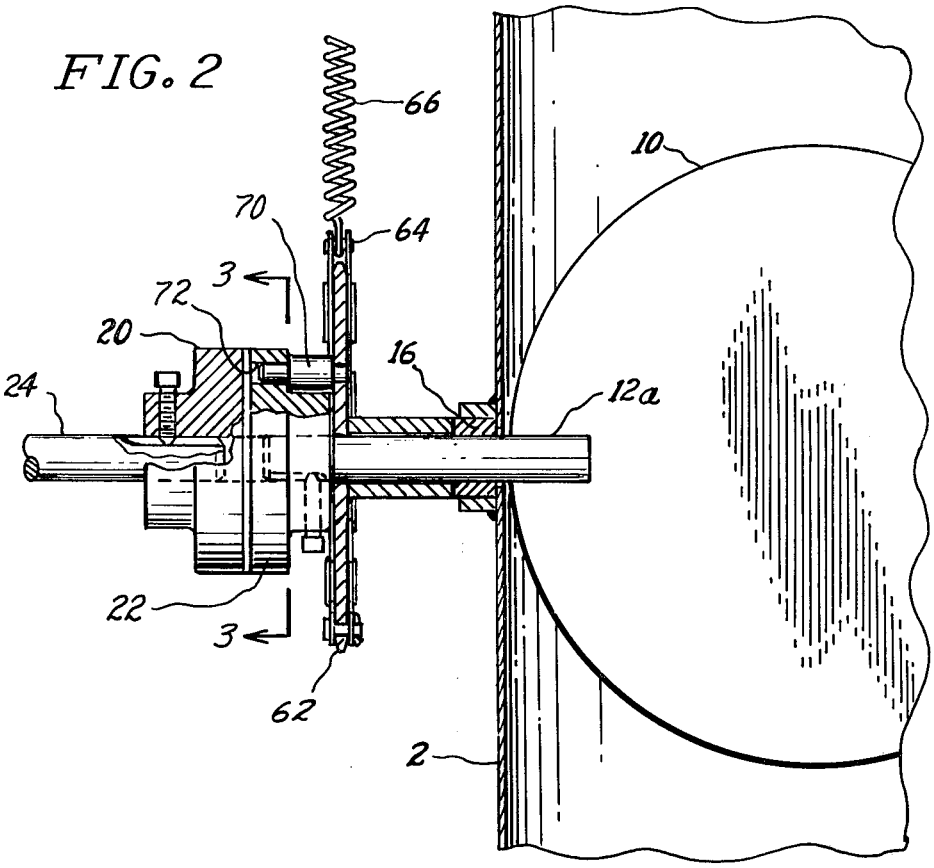
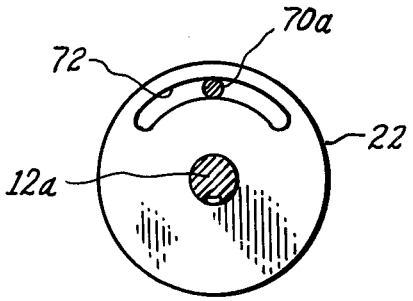
FIG. 3

AUTOMATIC ENERGY SAVER AND FIRE DAMPER FOR EXHAUST SYSTEMS

BACKGROUND OF THE INVENTION

In paint spray booths as now operated there is continuous air exhaust through an exhaust duct, even when no painting is being done. When paint spraying is resumed it is necessary to supply heated make-up air. This necessarily results in a very significant waste of energy.

The prior art does disclose a power operated damper in a ventilation duct which is automatically opened and closed in response to the starting and stopping of a wood working machine requiring a ventilation system to exhaust undesirable byproducts. See U.S. Pat. No. 3,616,745 issued to J. C. Russell, Sr. on Nov. 2, 1971. Also, U.S. Pat. No. 3,596,671 issued to Scharfenberger discloses a control mechanism operative to stop the operation of electrostatic operating equipment in response to the failure or the reduced efficiency of ventilating apparatus for a coating booth. However, this is the reverse of the exhaust duct control system disclosed herein.

It is also known to automatically actuate a fire damper in a ventilation duct to a closed position by a spring loaded arrangement responsive to the melting of a fusible link. See U.S. Pat. No. 3,283,691 issued on Nov. 8, 1966 to W. Reiter.

The exhaust system set forth herein is operable in a manner not disclosed by the known prior art to automatically close a damper in an exhaust duct from a paint spray booth in response to the cessation of paint spraying operations and to hold the damper closed against differentials in air pressure which may develop across the face of the damper; and this feature is combined with a fire prevention mechanism which operates to close the damper in the event of fire through a fusible link actuated mechanism coupled to the damper drive shaft.

BRIEF SUMMARY OF THE INVENTION

This invention has as its basic objective the saving of heat energy by automatically closing a damper in an exhaust duct leading from a paint spray booth when a paint spray gun is not being operated.

A further objective is to contain and limit fire which may break out in the spray booth by automatically closing the aforesaid damper in the exhaust duct in the event of fire.

The exhaust control system is comprised of a butterfly damper rotatably mounted on a drive shaft inside of an exhaust or ventilation duct leading from a paint spray booth. The damper drive shaft is coupled through power transmitting means to a reversible drive motor operable to rotate the damper between open and closed positions in response to spray booth operation. Switch means connected to the damper drive motor functions to energize the motor for rotation in one direction to close the exhaust duct damper when spraying operations are terminated, and to actuate the motor in the opposite direction to open the damper when spraying operations are commenced.

Advantageously, the aforesaid switch means may take the form of a hangar switch having an actuating arm which is moved to a first position thus serving to rotate the damper motor in a damper closing direction when a spray gun is hung on the hanger arm. When the spray gun is removed for paint spraying operations, the switch is actuated to a second position wherein the damper motor is reversed so as to rotate the damper to a fully open position.

In a particularly advantageous embodiment of the invention, the aforesaid power transmitting means incorporates a pair of limit switches respectively responsive to the rotation of the butterfly damper to a fully closed or a fully open position. A first limit switch is tripped to stop the drive motor when the damper is rotated to a fully open position, and a second limit switch is tripped to de-energize the damper motor when the damper is rotated to a fully closed position.

The aforesaid limit switches are preferably actuated by a follower block which moves in a linear path on a lead screw rotated by the damper drive motor. The lead screw and its follower block form a part of the aforesaid power transmitting means from the drive motor to the butterfly damper. A pin and slot connection between the follower block and a swing arm serves to rotate a power input shaft to the damper as the lead screw is rotated by the drive motor. This coupling arrangement ensures that air currents acting on the damper will not be able to rotate the damper away from its desired position because of the resistance against the rotation of the power input shaft to the damper offered by the lead screw and its follower block.

As a further beneficial aspect of this invention, the same aforesaid heat saving damper is also utilized to contain fires within the spray booth. A spring loaded sprocket on the damper drive shaft serves to override a clutch in the power transmission system from the drive motor to the damper if a fire breaks out in the spray booth. This is accomplished by the use of a fusible link located in the exhaust duct. When the fusible link melts, a tension spring is released to rotate the aforesaid sprocket to close the damper.

These and other objects and advantages of our invention will become readily apparent as the following description is read in conjunction with the accompanying drawings wherein like reference numerals have been used to designate like elements throughout the several views.

BRIEF DESCRIPTION OF THE DRAWINGS

FIG. 2 is a vertical section view through a portion of the power transmission to the exhaust control damper taken along lines 2—2 of FIG. 1; and FIG. 3 is a vertical section view taken along lines 3—3 of FIG. 2.

DESCRIPTION OF THE PREFERRED EMBODIMENT

Figure 1:
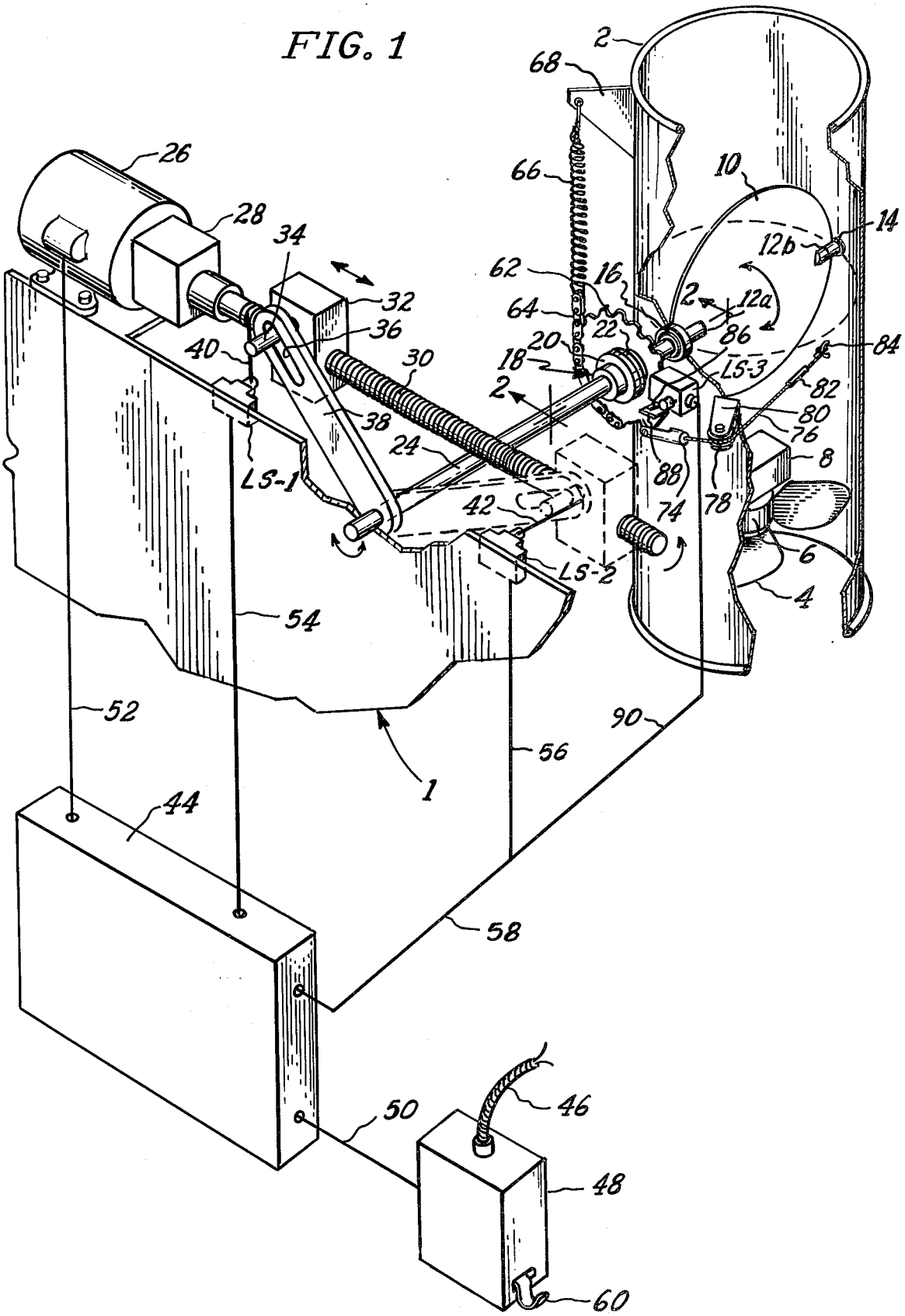
FIG. 1 is a perspective view of the control damper and its operating mechanisms.

The exhaust system control apparatus of this invention is intended to be used in conjunction with any type of spraying or painting operation where noxious or undesirable fumes are generated and must be discharged through an exhaust duct. It is common practice to continuously exhaust contaminated air from spray booths, even when no spraying or painting operation is taking place. This necessarily results in a very significant waste of energy because of the discharge of heated air. As hereinafter disclosed, the control apparatus of this invention operates to automatically close a damper in an exhaust duct from a spray booth or similar room where noxious fumes are generated, when no spraying or painting operation is taking place.

In FIG. 1, the exhaust system control apparatus of this invention is shown in partially diagrammatic form. Reference numeral 1 indicates one wall of a spray or paint booth having an exhaust duct 2 through which contaminated air is normally admitted to the atmosphere. As is normal practice, an exhaust fan 4 mounted within duct 2 by means of a bracket block 8 and driven by a motor 6 is utilized to exhaust air from the spray booth upwardly through duct 2. Rather than cycling exhaust fan motor 6, a damper 10 is utilized to open and close exhaust duct 2 in response to the starting and stopping of spraying operations.

Damper 10 is preferably of the butterfly type and consists of a disc or blade mounted on a drive shaft 12*a* for rotational movement therewith. Drive shaft 12*a* is rotatably supported in a bearing 16 mounted on the side of exhaust duct 2. The opposite side of damper 10 has a stub shaft 12*b* extending therefrom which is also rotatably supported within an oppositely disposed bearing 14. A clutch assembly, generally indicated by reference numeral 18, and having an input plate or side 20 and an output plate or side 22 is utilized to transmit driving power between a power input shaft 24 and damper drive shaft 12*a*. Clutch 18 and power input shaft 24 form part of power transmitting means drivingly connected between a motor 26 and damper drive shaft 12*a*. Although a fluid motor could also possibly be used, we have found it satisfactory to use a reversible electric motor as the drive motor 26. A speed reducing gear box is connected on the output side of motor 26, and power is transmitted from this gear box to power input shaft 24. This power transmission could be accomplished in various ways. We have found it particularly advantageous to use a lead screw 30 for this purpose. Lead screw 30 is driven from the output side of gear box 28 and has a follower block 32 mounted thereon in threaded engagement therewith. It will be understood that as lead screw 30 is rotated by motor 26 in opposite directions, follower block 32 will move back and forth thereon in a linear path. The transmission of power to input shaft 24 is completed by a swing arm 38 actuated by a pin 34 projecting from follower block 32. Pin 34 extends through a slot 36 formed in swing arm 38. Arm 38 is secured at its bottom end to one end of power input shaft 24 for rotation therewith. It will be apparent that as lead screw 32 moves back and forth in a linear path, the engagement of pin 34 within slot 36 will swing arm 38 in opposite directions to rotate power input shaft in a damper closing or opening direction.

A first limit switch LS-1 having a sensing finger 40 functions to stop motor 26 in response to contact by pin 34 when damper 10 has been revolved to its fully open position. When damper 10 has been rotated to its vertical, fully open position as shown in FIG. 1, follower block 32 will have been moved towards motor 26 on lead screw 30 to the position shown in FIG. 1 where pin 34 carried thereon contacts sensing finger 40 of limit switch LS-1. A second limit switch LS-2 stops motor 26 when damper 10 has been moved to its fully closed, horizontal position as shown in dotted lines in FIG. 1. Pin 34 on follower block 32 contacts sensing finger 42 of limit switch LS-2 when follower block 32 has been moved in the opposite direction on lead screw 30 to the phantom line position shown in FIG. 1 corresponding to the closed position of damper 10.

The starting and stopping of damper drive motor 26 is controlled through a solid state control panel 44. A power supply cable 46 is connected to control panel 44 through a control switch 48. Circuit lead connectors 50 and 52 complete a circuit between switch 48 and motor 26 through a printed circuit control board within control panel 44. Limit switches LS-1 and LS-2 are also connected to motor 26 through control panel 44 by their respective circuit leads 54 and 56, 58.

Damper 10 is operated between its open and closed positions by regulation of motor 26 in response to spray booth use. This may be accomplished in various ways as noted below. We have found it particularly effective for this purpose to utilize a hangar switch arm 60 on switch 48. Hangar arm 60 of control switch 48 supports a paint spray gun and is moved between first and second positions to close and open damper 10 through reversing operation of drive motor 26 in response to the hanging of a spray gun thereon and to the removal of the spray gun for spraying operations. When a spray gun is hung on switch arm 60 at the termination of spraying operations, switch 60 serves to actuate motor 26 for rotation in a first direction revolving lead screw 30 clockwise as viewed from the free end of lead screw 30 in FIG. 1. This serves to carry follower block 32 outwardly on lead screw 30, away from motor 26 to the phantom line position shown in FIG. 1. When follower block 32 reaches this outer position on lead screw 30, damper 10 will have been revolved to a fully horizontal, closed position within exhaust duct 2. Motor 26 is stopped when damper 10 has been rotated to its fully closed position by the contact of pin 34 of follower block 32 with sensing finger 42 of limit switch LS-2. It will be understood that as follower block 32 moves outwardly on lead screw 30, pin 34 will engage swing arm 30 within slot 36 and rotate arm 38 in a clockwise direction to the phantom line position shown in FIG. 1. This serves to transmit rotary power to power input shaft 24. As may best be understood by reference to FIG. 2, input plate 20 of clutch 18 is secured to power input shaft 24 for rotation therewith. Clutch 18 is of a well known design, and rotary movement is transmitted from input plate 20 to clutch output plate 22 through friction contact or appropriate sprague or ball contact means between the plates. Output clutch plate 22 is secured to damper drive shaft 12*a*, and thereby serves to rotate damper 10 as power input shaft 24 is rotated.

The automatic closing of damper 10 in response to the termination of painting operations when a spray gun is hung on switch arm 60 ensures that heated air will not be lost up duct 2 by continued, unnecessary ventilation when no spraying operation is taking place. A very significant savings in heat energy has been utilized by utilization of this exhaust control system. By limiting the loss of heated, conditioned air, the amount of makeup air heat otherwise required through heat losses out of a spray booth exhaust duct is greatly reduced.

When spraying operations are resumed, and the paint spray gun is lifted from switch gun 60, it will move to its second damper opening position. This serves to actuate motor 26 for reverse operation wherein lead screw 30 is rotated in a counterclockwise direction as indicated by the directional arrow on the free end of lead screw 30 in FIG. 1. As lead screw 30 rotates in this direction, follower block 32 will be moved in the opposite direction towards motor 26 to the position shown in solid lines in FIG. 1. The solid line position of lead screw 30 corresponds to the fully open, vertical position of damper 10.

Thus, when damper 10 has been rotated by lead screw 30, swing arm 38 and power input shaft 24 through clutch 18 to its fully open position, pin 34 on follower block 32 will strike sensing finger 40 of limit switch LS-1. This serves to stop motor 26 with damper 10 in its fully open position.

Those skilled in the art will appreciate that other types of sensing devices could be utilized to actuate switch 48 in response to the starting and stopping of painting operations in a spray booth. For example, a pressure transducer could be utilized in the air line to a spray gun. A decrease in air pressure indicative of the termination of paint spraying operations would serve to trip switch 48 so as to move motor 26 in its damper closing direction. When spraying operation is resumed and air pressure increases, the pressure transducer would actuate switch 48 to a second position wherein motor 26 would be rotated to open damper 10. It is also contemplated that a photoelectric eye could be utilized in a spray booth to sense the movement of articles into the spray booth for spraying. The electric eye would operate motor 26 through switch 48 to open damper 10 as articles move into the booth for spraying. When no articles are moving through the booth, indicating the termination of spraying operations, the photoelectric eye would serve to actuate switch 48 so as to rotate motor 26 in the opposite direction to close damper 10.

The exhaust apparatus of this invention also comprises a fire limiting feature. For this purpose a sprocket 62, roller chain 64 and spring 66 are utilized as torque transmitting means to rotate damper 10 to a closed position in the event of fire. This torque transmitting apparatus and the overall fire prevention system may best be understood by reference to FIGS. 1, 2 and 3. Although torque could be transmitted to butterfly damper 10 for fire containing purposes through some means other than damper drive shaft 12*a*, we have found it convenient and particularly advantageous to mount sprocket 62 directly on damper drive shaft 12*a* in cooperative relationship with clutch 18 for this purpose. Sprocket 62 is freely rotatable on damper drive shaft 12*a*, and normally does not rotate as the damper 10 is moved between open and closed positions by power input shaft 24 in response to driving power transmitted through lead screw 30 and swing arm 38 from motor 26. Roller chain 64 is pinned at one end thereof to sprocket 62 and has enough wrap around sprocket 62 to rotate it through the desired angular displacement for rotating damper 10 to its fully closed position from its fully open position. Coil spring 66 is attached to the free end of roller chain 64 and is secured at its opposite end to a bracket 68 affixed to the outside surface of exhaust duct 2. Spring 66 is placed in tension so as to normally bias sprocket 62 for rotation of damper 10 to its closed position. Connecting means are provided between sprocket 62 and output clutch plate 22 in such a way as to transmit rotary power to output clutch plate 22 when sprocket 62 is rotated in the event of fire, but so as to prevent the rotation of sprocket 62 by clutch output plate 22 during normal operation of damper 10 by drive motor 26 and power input shaft 24. This is effectively accomplished by utilizing a connecting pin 70 having a reduced diameter end at one end thereof affixed to sprocket 62, as by a force fit in an aperture within the sprocket disc. The opposite, reduced diameter end 70*a* of connecting pin 70 is received within an arcuate slot 72 formed in output clutch plate 22, as clearly appears in FIGS. 2 and 3. Arcuate slot 72 is of sufficient arcuate length that output clutch plate 22 can rotate in opposite directions with input clutch plate 20 during normal, motor operation of damper 10 so as to not contact pin segment 70*a* and rotate sprocket 62. The arcuate length of slot 72 permits damper 10 to be rotated through its full angular displacement of 90 degrees through clutch assembly 18 and damper shaft 12*a* without engaging pin segment 70*a* and rotating sprocket 62.

A restraining device normally holds sprocket 62 against rotation by spring 66. This device preferably takes the form of a cable connection incorporating a fusible link. For this purpose a clevis 74 is attached to sprocket 62 as shown in FIG. 1, and a restraining cable 76 extends from clevis 74 around a guide pulley 78 to a point of connection to one wall duct 2. A bracket clip 84 is utilized to secure cable 76 to the opposite wall of duct 2 from drive shaft 12*a* and sprocket 62. Pulley 78 is supported on a bracket 80 affixed to the outside wall of exhaust duct 2. A fuxible link 82 is connected in cable 76. With clevis 74 and restraining cable 76 in place, spring 66 is placed in tension as it is affixed to bracket 68. Cable 76 resists the bias of spring 66 and restrains sprocket 62 against the rotational movement which would otherwise be imparted to it by tensioned spring 66. In the event of fire, fusible link 82 will melt at a predetermined temperature indicative of an excessive heat condition. When this happens, cable 76 will be released and spring 66 will rotate sprocket 62. Sufficient tension is imparted to spring 66 that roller chain 64 attached thereto will revolve sprocket 62 through a predetermined angular displacement which will ensure the rotation of damper 10 to its fully closed position. Spring 66 and roller chain 64 will rotate sprocket 62 in a clockwise direction as viewed in FIG. 1. This is the same direction in which shaft 24 is rotated by swing arm 38 to rotate damper 10 to its closed position through operation of motor 26. As sprocket 62 rotates through its predetermined angular displacement, pin segment 72*a* revolving therewith will engage one end of output clutch plate 22 and thereby transmit torque from sprocket 62 through clutch output plate 22. Since plate 22 is affixed to damper drive shaft 12*a*, it will rotate damper 10 to a fully closed position as sprocket 62 is revolved by spring 66. The closing of damper 10 in the event of fire will limit and contain any fire to the spray booth in which the exhaust apparatus is located by preventing a chimney effect through exhaust duct 2. This also serves to reduce the possibility of roof ignition from any fire within the spray booth. Clutch assembly 18 is an overriding clutch. The friction or coupling action of input plate 20 to clutch output plate 22 is overridden by the torque imparted to clutch output plate 22 by the rotation of sprocket 62. This serves to rotate damper 10 to a closed position regardless of the rotational position imparted to power input shaft 24 by drive motor 26.

As a further safety feature, drive motor 26 is de-energized when an excessive heat condition melts fusible link 82, causing the closing of damper 10. This is accomplished by an additional limit switch LS-3 connected through its circuit lead 90 and lead 58 with control panel 44. Limit switch LS-3 is normally held in a closed position by a trip lug 88 affixed to sprocket 62 for rotation therewith. Trip lug 88 normally engages trip finger 86 of limit switch LS-3. When sprocket 62 is rotated in a clockwise direction as viewed in FIG. 1 by cable 66 in the event of a fire emergency, lug 88 is rotated out of contact with sensing finger 86. Limit switch LS-3 then functions to open the circuit to drive motor 26 so that it cannot be actuated to operate damper 10.

As noted above, various other types of power transmitting arrangements may be utilized to drive damper input shaft 24 from motor 26. It is conceivable that motor 26 could directly drive power input shaft 24. However, the arrangement disclosed herein utilizing lead screw 30 ensures that pressure differentials across damper 10 caused by air currents will not cause damper 10 to rotate from its desired position when motor 26 is de-energized. The resistance of follower block 32 on lead screw 30 to the rotation of swing arm 38, as might be caused by air pressure on damper 10, prevents the undesired rotation of damper 10.

It is also contemplated that a time delay relay could be utilized within control panel 44. Such a relay would incorporate a preset time delay so as to avoid the actuation of motor 26 when hangar arm 60 of switch 48 is moved to either one of its positions by the removal of placement of a paint spray gun thereon. If the spray gun is picked up and then put down again in a very short period of time, the time delay relay will avoid actuation of motor 26. The showing of motor 26 and its power transmitting means to damper 10 is partially diagrammatic. In actual practice, motor 26 and its connecting drive arrangement incorporating lead screw 30, swing arm 38 and power shaft 24, are mounted in a compact arrangement directly on exhaust duct 2.

It is contemplated that various other changes may be made in the construction, arrangement and operation of the exhaust system apparatus disclosed herein, without departing from the spirit and scope of our invention as defined by the following claims.

What is claimed is:

1. Exhaust apparatus for a spray booth comprising:
an exhaust duct adapted to receive and discharge exhaust air from a spray booth;
a damper mounted in said exhaust duct for movement between open and closed positions therein;
a reversible motor for imparting movement to said damper in opposite directions between said open and closed positions;
power transmitting means drivingly connected between said motor and said damper;
a first limit switch operative in response to the movement of said damper to said closed position to stop said motor;
a second limit switch operative in response to the movement of said damper to said open position to stop said motor; and
switch means connected to said motor and movable to a first position in response to the termination of spraying operation to actuate said motor for movement in one direction to close said damper and movable to a second position in response to the commencement of spraying operation to actuate said motor for movement in the opposite direction to open said damper.

2. Exhaust apparatus as defined in claim 1 wherein:
said switch means is a hanger switch having an actuating arm movable to said first position when a spray gun is hung thereon at the termination of spraying operations, and movable to said second position in response to the lifting of said spray gun therefrom to commence spraying operation.

3. Exhaust apparatus as defined in claim 1 wherein:
said power transmitting means comprises a lead screw rotatably driven by said motor, a follower block on said lead screw movable in opposite directions in a linear path in response to the rotation of said lead screw in opposite directions by said motor, a swing arm mounted on a rotatable power input shaft drivingly connected to said damper for rotation thereof, and drive means between said follower block and said swing arm whereby said swing arm is swung to rotate said power input shaft as said follower block is moved in a linear path by rotation of said lead screw.

4. Exhaust apparatus as defined in claim 3 wherein:
said first and second limit switches are positioned to be tripped by the movement of said follower block to opposed linear positions corresponding to the movement of said damper to said closed and open positions.

5. Exhaust apparatus as defined in claim 1 and further including:
fire limiting apparatus comprising torque transmitting means including spring means biased to rotate said damper to a closed position, restraining means normally resisting the bias of said spring means and thereby preventing the rotation of said damper by said torque transmitting means, and a fusible link connected in said restraining means, whereby the melting of said fusible link in response to an excessive heat condition indicative of fire will release said restraining means and permit said spring means to rotate said damper to said closed position.

6. Exhaust apparatus for a spray booth comprising:
an exhaust duct adapted to receive and discharge air from a spray booth;
a damper mounted on a drive shaft in said exhaust duct for rotational movement with said drive shaft between open and closed positions therein;
a reversible motor for imparting rotational movement to said drive shaft in opposite directions to open and close said damper;
power transmitting means drivingly connected between said motor and said drive shaft;
control means responsive to the termination of spraying operation in a spray booth to actuate said motor in a first direction to move said damper to a closed position in said duct, and to actuate said motor in the opposite direction to open said damper in response to the commencement of spraying operation; and
fire limiting apparatus comprising torque transmitting means including spring means biased to rotate said damper to a closed position, restraining means normally resisting the bias of said spring means and thereby preventing the rotation of said damper by said torque transmitting means, and a fusible link connected in said restraining means, whereby the melting of said fusible link in response to an excessive heat condition indicative of fire will release said restraining means and permit said spring means to rotate said damper to said closed position.

7. Exhaust apparatus as defined in claim 6 wherein:
said power transmitting means includes an overriding clutch connected between a power input shaft driven from said motor and said drive shaft; and
said torque transmitting means includes drive means operative to override said clutch and drive said clutch to rotate said damper drive shaft in a direction to rotate said damper to said closed position in response to the melting of said fusible link regardless of the rotational position imparted to said power input shaft by said motor.

8. Exhaust apparatus as defined in claim 7 wherein:

said overriding clutch has an input plate connected to said power input shaft and an output plate connected to said damper drive shaft, said input plate being drivingly associated with said output plate;

said torque transmitting means comprises:

a rotatably supported sprocket having said spring means attached thereto, said spring means being normally tensioned in a direction to rotate said sprocket and said sprocket being held against rotation by said restraining means; and connector means between said sprocket and said clutch output plate operative to transmit torque from said sprocket through said clutch output plate to said damper drive shaft when said sprocket is rotated by said spring means in response to the melting of said fusible link.

9. Exhaust apparatus as defined in claim 8 wherein:

said sprocket is rotatably supported on said damper drive shaft.

10. Exhaust apparatus as defined in claim 9 wherein:

said connecting means comprises a pin affixed to said sprocket for rotation therewith and extending into an arcuate slot in said clutch output plate, whereby said output plate is rotated to drive said damper shaft by the engagement of said pin with one end of said slot when said sprocket is rotated by said spring means.

* * * * *